US007562536B2

(12) United States Patent
Harrod et al.

(10) Patent No.: US 7,562,536 B2
(45) Date of Patent: Jul. 21, 2009

(54) METHOD AND APPARATUS TO SENSE AND CONTROL COMPRESSOR OPERATION IN AN HVAC SYSTEM

(75) Inventors: Gregory Ralph Harrod, Wichita, KS (US); Jeffrey Lee Tucker, Wichita, KS (US)

(73) Assignee: York International Corporation, York, PA (US)

( * ) Notice: Subject to any disclaimer, the term of this patent is extended or adjusted under 35 U.S.C. 154(b) by 472 days.

(21) Appl. No.: 11/327,084

(22) Filed: Jan. 6, 2006

(65) Prior Publication Data

US 2006/0196202 A1 Sep. 7, 2006

Related U.S. Application Data

(60) Provisional application No. 60/657,938, filed on Mar. 2, 2005.

(51) Int. Cl.

| | |
|---|---|
| ***F25B 1/00*** | (2006.01) |
| ***F25B 49/00*** | (2006.01) |
| ***F25B 7/00*** | (2006.01) |
| ***G05B 11/01*** | (2006.01) |

(52) U.S. Cl. ..... 62/228.1; 62/228.4; 62/175; 62/510; 700/12; 700/27

(58) Field of Classification Search ..... 73/1.01, 73/168, 865.9; 702/90, 105, 108, 113, 122, 702/189; 417/18, 44.1, 53, 63; 62/228.1, 62/531, 331, 77, 228.4, 175, 510, 230; 700/12, 700/28, 32, 47, 49, 27

See application file for complete search history.

(56) References Cited

U.S. PATENT DOCUMENTS 3,890,836 A * 6/1975 McKenzie et al. ..... 73/168
5,009,075 A * 4/1991 Okoren ..... 62/127
5,042,265 A 8/1991 Baldwin et al.
5,065,813 A 11/1991 Berkeley et al.
5,237,826 A 8/1993 Baldwin et al.
5,276,630 A * 1/1994 Baldwin et al. ..... 700/276
5,491,649 A 2/1996 Friday, Jr. et al.
5,648,722 A 7/1997 Merry et al.
5,787,027 A 7/1998 Dolan et al.
5,816,059 A 10/1998 Ficchi, Jr. et al.

(Continued)

OTHER PUBLICATIONS

Thermistors, Dec. 21, 2005, by temperatures.com, p. 1 par. 7 www.temperatures.com/thermistors.html.*

*Primary Examiner*—Chen-Wen Jiang
(74) *Attorney, Agent, or Firm*—McNees Wallace & Nurick, LLC

(57) ABSTRACT

An HVAC system and method for configuring a controller to control a compressor including a detection system provided to determine a type of compressor. The detection system includes a processor; and a load sensing circuit connected between the processor and a controller. The controller has a plurality of output connections connectable to a compressor. The load sensing circuit senses whether a load is present on each output connection of the plurality of output connections and provides a load signal to the processor indicating whether a load is present on each output connection. The load signals are processed with the processor to determine the type of compressor is present. The controller is configured to control the compressor in response to the determined type of compressor.

9 Claims, 6 Drawing Sheets

U.S. PATENT DOCUMENTS 5,818,347 A 10/1998 Dolan et al.
5,824,921 A 10/1998 Kanai
6,089,310 A 7/2000 Toth et al.
6,179,214 B1 1/2001 Key et al.
6,220,043 B1 4/2001 Chaney, Jr. et al.
6,223,544 B1 5/2001 Seem
6,324,854 B1 12/2001 Jayanth
6,402,043 B1 6/2002 Cockerill
6,473,706 B1 * 10/2002 Gallo et al. ..... 702/105
6,488,081 B2 12/2002 Rayburn et al.
6,560,976 B2 5/2003 Jayanth
7,137,567 B2 * 11/2006 Jeffery ..... 236/94
2003/0060933 A1 3/2003 Sulfstede
2003/0209015 A1 * 11/2003 Song ..... 62/6
2004/0181355 A1 * 9/2004 Liu et al. ..... 702/108
2005/0196285 A1 * 9/2005 Jayanth ..... 417/44.11
2005/0228607 A1 * 10/2005 Simons ..... 702/122
2006/0182635 A1 * 8/2006 Jayanth ..... 417/44.1
2007/0098566 A1 * 5/2007 Heo ..... 417/44.1
2007/0239397 A1 * 10/2007 Bourne et al. ..... 702/183

* cited by examiner

METHOD AND APPARATUS TO SENSE AND CONTROL COMPRESSOR OPERATION IN AN HVAC SYSTEM

FIELD OF THE INVENTION

The present invention is directed to heating, ventilation and air conditioning (HVAC) systems. In particular, the present invention is directed to methods and systems that automatically sense the type of compressor present in the HVAC system.

BACKGROUND OF THE INVENTION

Controllers are used to provide control to the various components of an HVAC or refrigerant system, including one or more compressors incorporated in the system. Compressors are connected to the controller using one or more terminals that supply power to the compressor and control the operation of the compressor in order to operate the system. While a controller activates the compressors, it does not detect what type of compressor is present in the system.

Detection of the specific type of compressor allows the system to take advantage of special features of the compressor. For example, a system able to detect the presence of a multiple capacity reciprocating compressor allows the system to provide the appropriate control scheme to take advantage of the multiple capacities present in the compressor.

One known system used for sensing the presence of components in the system is disclosed in U.S. Pat. No. 6,089,310 (the '310 Patent). The '310 Patent is a thermostat for an HVAC system that includes a sensing transformer to confirm that a load has been applied to a preselected circuit. The sensing transformer is coupled to the load and generates a first indicator signal indicative of power being applied to the component. The thermostat controls the HVAC system by pulses to a latching relay to control a temperature load to an operating state selected by the thermostat. Current sensors indicate current flow through a particular temperature load, corresponding to an operating state. If the indication from the current sensors does not match the operating state selected by the thermostat, the process is repeated with a pulsing of the latch relays and comparison of the current sensors. Since the thermostat senses the load to the cooling or heating units, the thermostat is able to determine whether the heating or cooling unit has actually been turned on or off in response to a signal from the thermostat. However, the '310 Patent system has the drawback that it merely determines whether a system is on or off and does not determine what type or system or what type of compressor is present in the system. Further, the '310 system does not configure the controller to the type of system or compressor in response to the signal.

What is needed is a controller for an HVAC system that can automatically sense the type of compressor that is installed in the system and configures the controller output from the controller for the corresponding compressor attached to the system.

SUMMARY OF THE INVENTION

The present invention includes a method for configuring a controller to control a compressor including a detection system provided to determine a type of compressor. The detection system includes a processor; and a load sensing circuit connected between the processor and a controller. The controller has a plurality of output connections connectable to a compressor. The load sensing circuit senses whether a load is present on each output connection of the plurality of output connections and provides a load signal to the processor indicating whether a load is present on each output connection. The load signals are processed with the processor to determine the type of compressor connected to the controller. The controller is configured to control the compressor in response to the determined type of compressor.

The present invention also includes an HVAC system having an evaporator, a condenser, and a compressor connected in a closed loop refrigerant system. The system includes a control system to control the closed loop refrigerant system including a controller having a plurality of output connections capable of being electrically connected to a compressor. The compressor is electrically connected to the controller by at least one electrical connection. The system also includes a load sensing circuit and a processor electrically connected to at least two of the plurality of output connections of the controller. The load sensing circuit is configured to generate a load signal for the processor in response to a load being present on the at least two of the plurality of output connections of the controller. The processor is configured to determine a type of compressor based on load signals from the load sensing circuit. The processor provides instructions to configure the controller to operate with the determined compressor type in response to the type of compressor determined by the processor.

An advantage of the present invention is that the controller is able to detect the type of compressor attached to the system. Knowing the type of compressor that is connected allows the HVAC controller to apply an operating mode that has been designed for the specific type of compressor present.

Another advantage of the present invention is that wiring errors may also be detected by the controller. For example, if a detected load/no load combination is not a permissible combination, the HVAC control can prevent operation of the unit and display a wiring error message through an output such as a thermostat LED.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
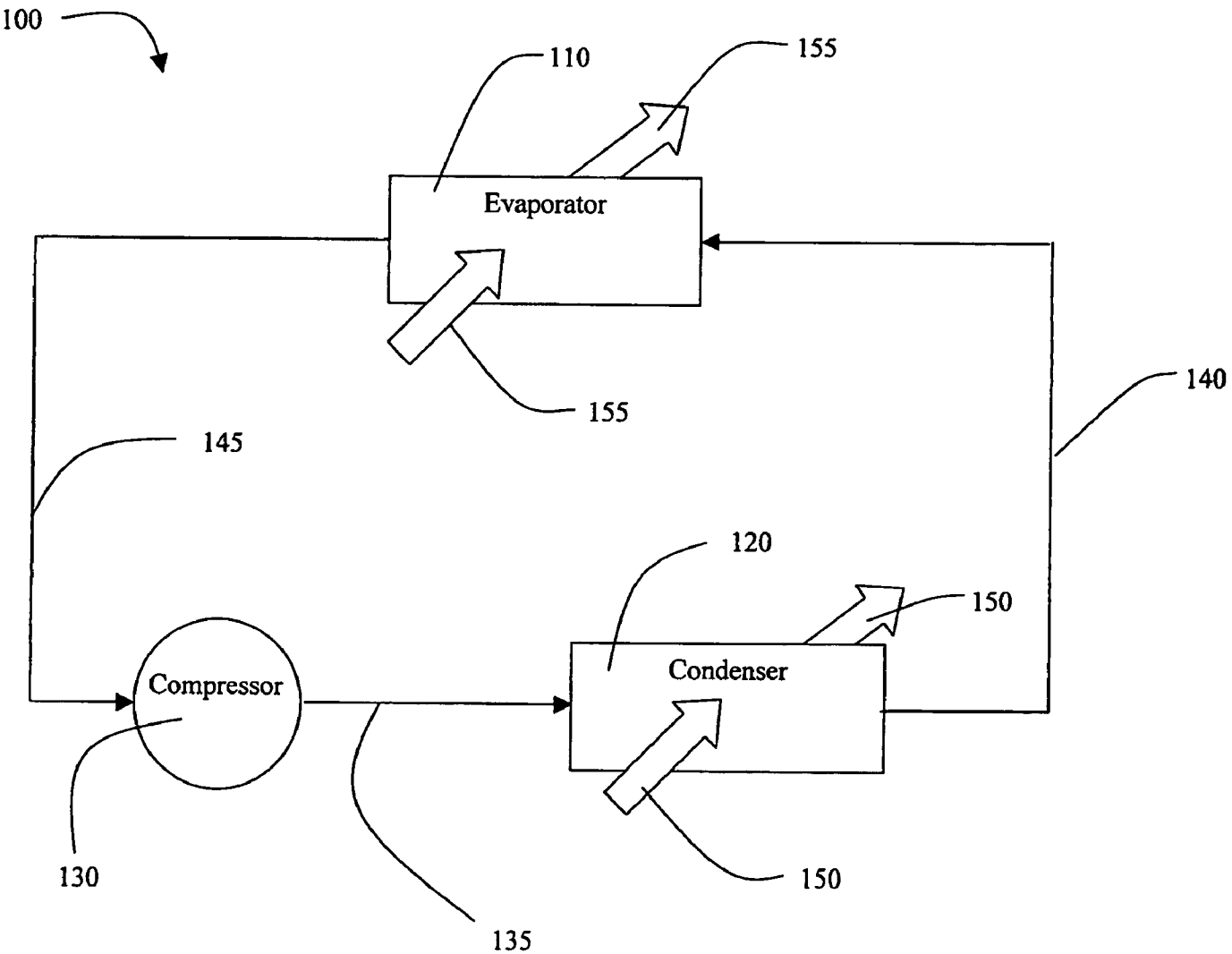
FIG. 1 schematically illustrates a refrigeration or HVAC system.

FIG. 1 illustrates an HVAC or refrigeration system that that can be used with the present invention. Refrigeration system 100 includes a compressor 130, a condenser 120, and an evaporator 110. Refrigerant is circulated through the refrigeration system 100. The compressor 130 compresses a refrigerant vapor and delivers it to the condenser 120 through compressor discharge line 135. The compressor 130 is any suitable type of compressor, including, for example, screw compressor, scroll compressor, reciprocating compressor, rotary compressor, or centrifugal compressor. In particular, the compressor 130 may be a single stage or multiple-stage or multiple capacity compressor, e.g., a two-stage compressor. A single stage compressor is generally one that includes a single output capacity. The control for a single stage compressor typically includes a single input line to the compressor 130. A two-stage compressor is a compressor 130 that has two output capacities. The control for a two-stage compressor may include one, two or three inputs to control the compressor 130.

The refrigerant vapor delivered by the compressor 130 to the condenser 120 enters into a heat exchange relationship with a first heat transfer fluid 150 heating the fluid 150 while undergoing a phase change to a refrigerant liquid as a result of the heat exchange relationship with the fluid 150. Suitable fluids for use as the first heat transfer fluid 150 include, but are not limited to, air and water. In a preferred embodiment, the refrigerant vapor delivered to the condenser 120 enters into a heat exchange relationship with air as the first heat transfer fluid 150. The first heat transfer fluid 150 is moved by use of a fan (not shown), which moves the first heat transfer fluid 150 through condenser 120 in a direction perpendicular the cross section of the condenser 120. Although a fan or blower is discussed as the fluid moving means, any fluid moving means may be used to move fluid through the condenser.

The refrigerant leaves the condenser 120 through the evaporator inlet line 140 and is delivered to an evaporator 110. The evaporator 110 includes a heat-exchanger coil. The liquid refrigerant in the evaporator 110 enters into a heat exchange relationship with a second heat transfer fluid 155 and undergoes a phase change to a refrigerant vapor as a result of the heat exchange relationship with the second fluid 155, which lowers the temperature of the second heat transfer fluid 155. Suitable fluids for use as the second heat transfer fluid 155 include, but are not limited to, air and water. In a preferred embodiment, the refrigerant vapor delivered to the evaporator 110 enters into a heat exchange relationship with air as the second heat transfer fluid 155. The second heat transfer fluid 155 is moved by use of a blower (not shown), which moves the second heat transfer fluid 155 through evaporator 110 in a direction perpendicular to the cross section of the evaporator 110.

The vapor refrigerant in the evaporator 110 exits the evaporator 110 and returns to the compressor 130 through a compressor suction line 145 to complete the cycle. It is to be understood that any suitable configuration of condenser 120 and/or evaporator 110 can be used in the system 100, provided that the appropriate phase change of the refrigerant in the condenser 120 and evaporator 110 is obtained. The conventional refrigerant system includes many other features that are not shown in FIG. 1. These features have been purposely omitted to simplify the figure for ease of illustration.

Figure 2:
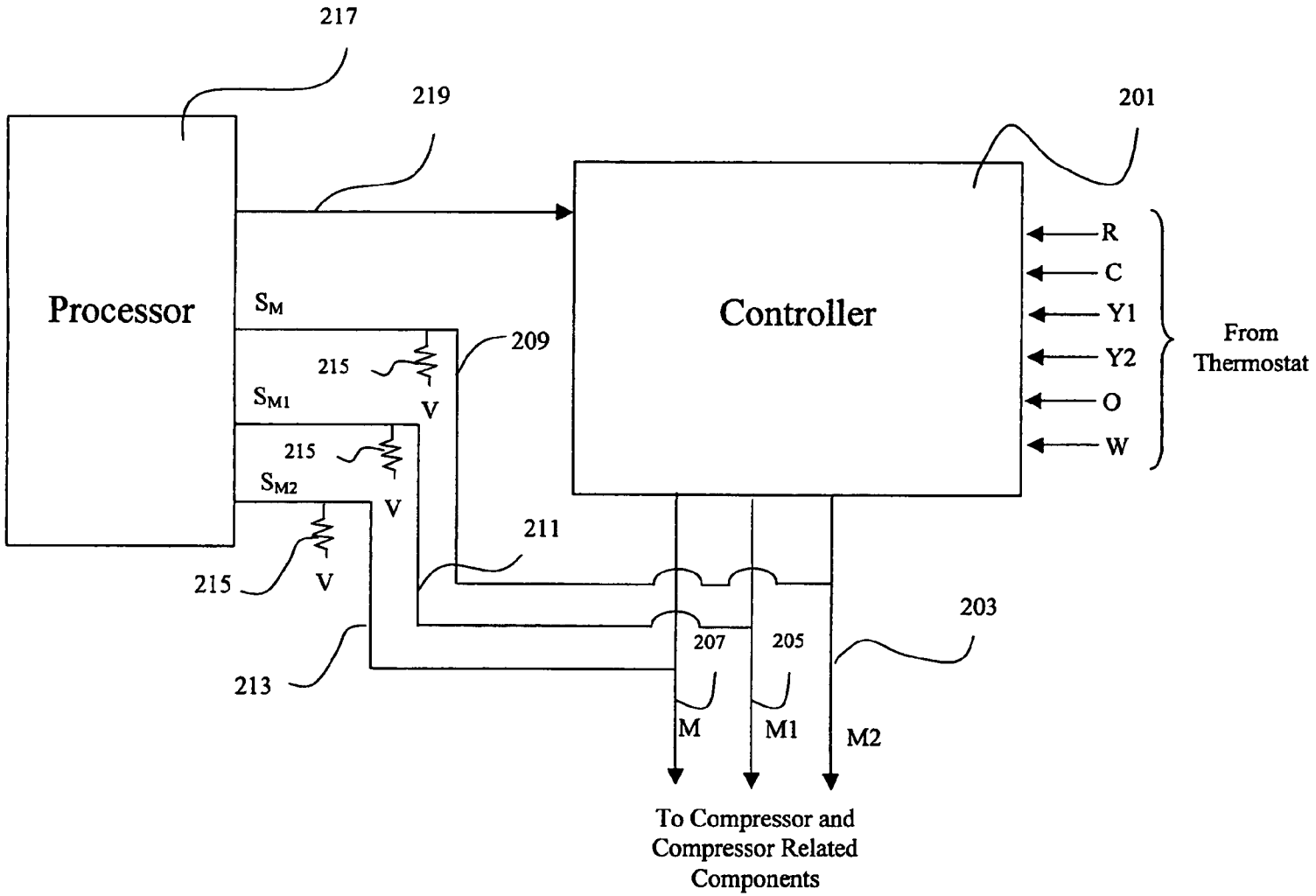
FIG. 2 schematically illustrates a control system of the present invention.

FIG. 2 schematically illustrates a control system according to one embodiment of the present invention. The control system includes a controller 201 connected to a compressor and a processor 217. The controller 201 is a device that receives signals from input sources, such as thermostats and/or sensors and provides control to the components of the system, including the compressors. As shown in FIG. 2, the inputs may include signals from the thermostat, such as "R", "C", "Y1", "Y2", "O" and "W" signals, which are typical signal designations from a thermostat. Although the signals shown in FIG. 2 include "R", "C", "Y1", "Y2", "O" and "W" signals, the signals may be any signal that provides the controller with an instruction to control the closed loop refrigerant system. The controller uses the input signals to determine how to control the system. In response to the input signals, the controller 201 provides output signals on output lines including the "M2" output signal on output line 203, the "M1" output signal on output line 205, and the "M" output signal on output line 207, which output lines may control the compressor. The processing of the input signals to produce the output signals is accomplished by the controller 201 in accordance with programming, logic or other processing method within the controller 201. In order to efficiently and safely operate the compressors, the programming, logic or other processing method is configured to the type of compressor attached to the system. In order to provide the control to the compressor, output lines 203, 205 and 207 are electrically connected to the compressor or compressor related components. Output lines 203, 205 and 207 may be connected directly to the compressor to provide control, but may also be connected to related equipment including relays, contactors, or solenoids for use in the operation of the compressor. For example, a device such as a relay may be connected to output line 207 and used as a compressor "ON" indicator. These devices would be energized by a signal from the controller 201 to indicate that compressor operation is desired. Suitable signals for use in the input and output of the controller 201 include, but are not limited to, electrical loads and/or predetermined voltages. For example, controller 201 may provide power to and activate the compressor 130 when controller 201 provides a signal, preferably on one or more of lines 203, 205 and 207.

Figure 4:
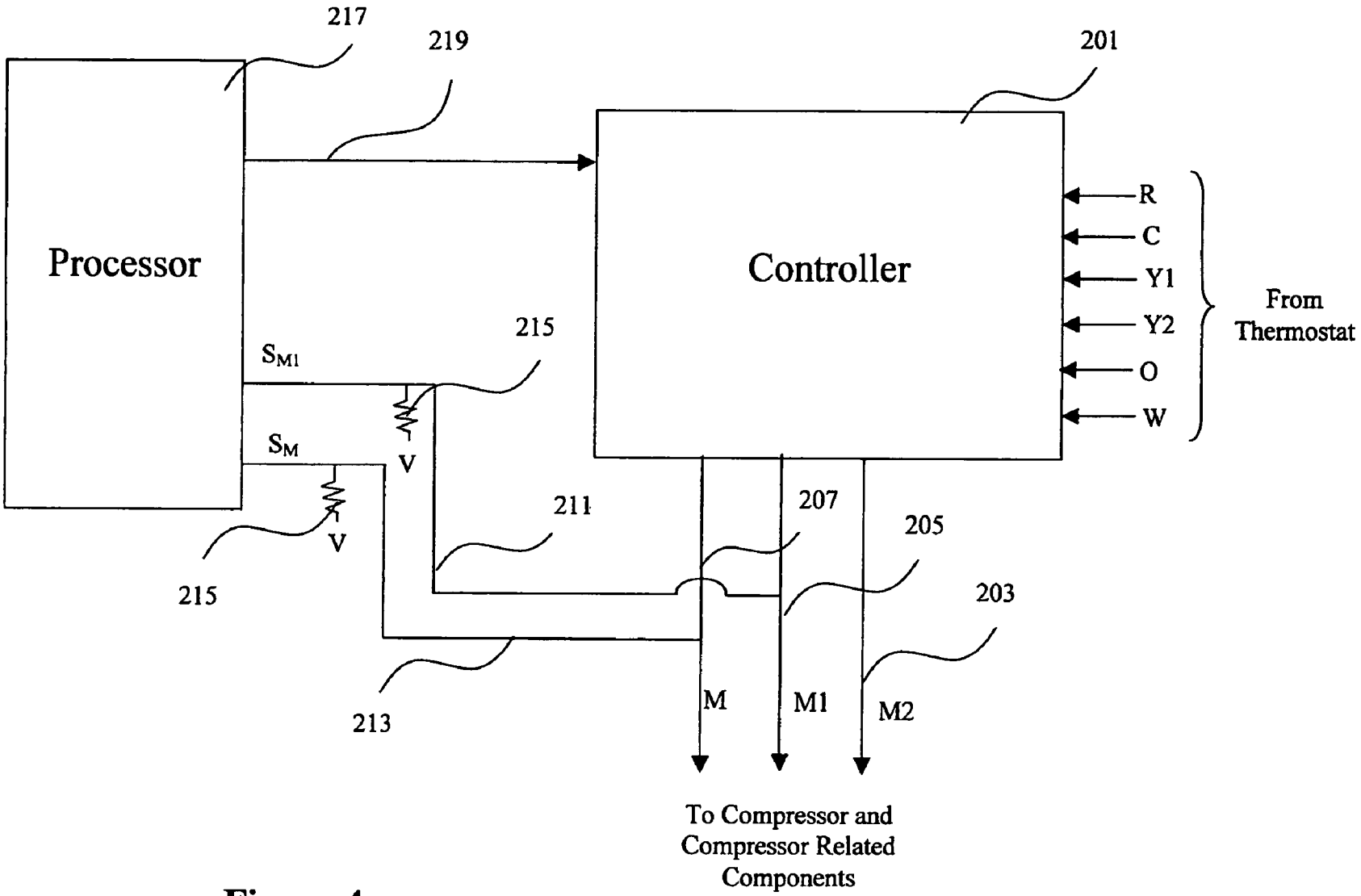
FIG. 4 schematically illustrates a control system according to an alternate embodiment of the present invention.

Processor 217 is a device that processes combinations of loads present on load sensor lines 209, 211 and 213. The combination of loads is determined by sensing voltages or other electrical signals from a load sensing circuit 215 and the load sensing circuit 215 provides the sensed loads to the processor 217 via load sensor lines 209, 211 and 213. Electrical devices connected to the controller 201, including, but not limited to, the compressor and the compressor related components (e.g., solenoids, indicator lights, etc.) create a load (e.g., an electrical resistance or impedance) that may be sensed by the load sensing circuit 215. As shown in the embodiment of FIG. 2, if the processor 217 reads a voltage equal to voltage "V" through the load sensing circuit 215, then the processor 217 determines that there is no load on output line 203, 205 or 207. If the processor 217 senses a voltage of zero volts (i.e., the ground voltage level), the output line 203, 205 or 207 has a load on it. Although FIG. 2 shows connections to loads on each of output lines 203, 205 and 207, any combination of connections to loads may be present, including one or more of a connection on output lines 203, 205 and/or 207. Although FIGS. 2 and 4 are shown with pull-up resistor resistive arrangements as load sensing circuits 215, the loads could be sensed by another means other than using a pull-up resistor. Different circuitry such as an analog-to-digital converter could be used.

The outputs from the controller 201 are provided as a function of the inputs from the thermostat or a sensor device. For example, the thermostat may provide a signal (e.g., a signal on "Y1") that provides an instruction to the controller 201 that additional refrigerant compression (i.e., activation of the compressor or compressors) is required. The controller 201 then provides output signals "M", "M1" and "M2," as appropriate, to the compressor on output lines 207, 205 and 203, respectively. Preferably, the controller 201 is configured to the type of compressor 130 attached to the system in order to provide safe and efficient operation of the compressor 130. The output signals correspond to the appropriate terminals attached to the compressor 130. The specific arrangement of the terminals attached to the compressor 130 is dependent upon the type of compressor 130 present in the system. One type of compressor 130 may be a single-stage compressor that has a load, and a corresponding output signal during operation, on M only (i.e., a connection to line 207 ). The single-stage compressor has no connection to output lines 203 and 205. Another type of compressor 130 may be two-stage reciprocating compressor, which has loads on M1 and M2 (i.e., connections on lines 205 and 203 ), having corresponding output signals during operation. The two-stage reciprocating compressor has no connection to output line 207. Another type of compressor 130 may be a two-stage scroll compressor, which has a load on M and M2 (i.e., connections on lines 207 and 203 ), having corresponding output signals during operation. The two-stage scroll compressor has no connection to output line 205.

In order to configure the controller 201 to operate the particular compressor 130, the controller 201 receives a signal from the processor 217 via line 219 indicating the type of compressor and the controller 201 is configured to the corresponding type of compressor. Although FIGS. 2 and 4 show a signal line 219, the processor and controller may be integrated into the same device, such as a single microprocessor, to provide both sensing of the output lines 203, 205 and 207 and the processing of input signals from the thermostat or other input device to provide output signals. In order to determine the type of compressor, processor 217 senses loads on output lines from the controller 201 by sensor lines 209, 211 and 213. The load signals provided by load sensor lines 209, 211 and 213 to processor 217 may correspond to voltages, which depend on the presence or absence of a load on the output lines 203, 205 or 207. Load sensor line 209, connected to output line 203, provides load signal "$S_M$" to processor 217. Load sensor line 211, connected to output line 205, provides load signal "$S_{M1}$" to processor 217. Load sensor line 213, connected to output line 203, provides load signal "$S_{M2}$" to processor 217. The processor is connected to the controller 201 through line 219, which communicates the type of compressor determined by the processor 217 to the controller 201, which is appropriately configured to the type of compressor attached. Configuration of the controller 201 may take place in any suitable manner, including, but not limited to programming of a microprocessor in the controller 201 to provide control signals appropriate to the type of compressor attached to the system. Connections for the various types of compressors are shown in Table 1.

TABLE 1

| Type of Compressor | M Wiring Connection | M1 Wiring Connection | M2 Wiring Connection |
|---|---|---|---|
| Single Stage | Yes | No | No |
| Two-Stage Scroll Compressor | Yes | No | Yes |
| Two-Stage Reciprocating Compressor | No | Yes | Yes |

Although Table 1 shows the connections for a single stage compressor, a two-stage scroll compressor and a two-stage reciprocating compressor, any compressor having a predetermined combination of connections may be used with the system of the present invention.

Figure 3:
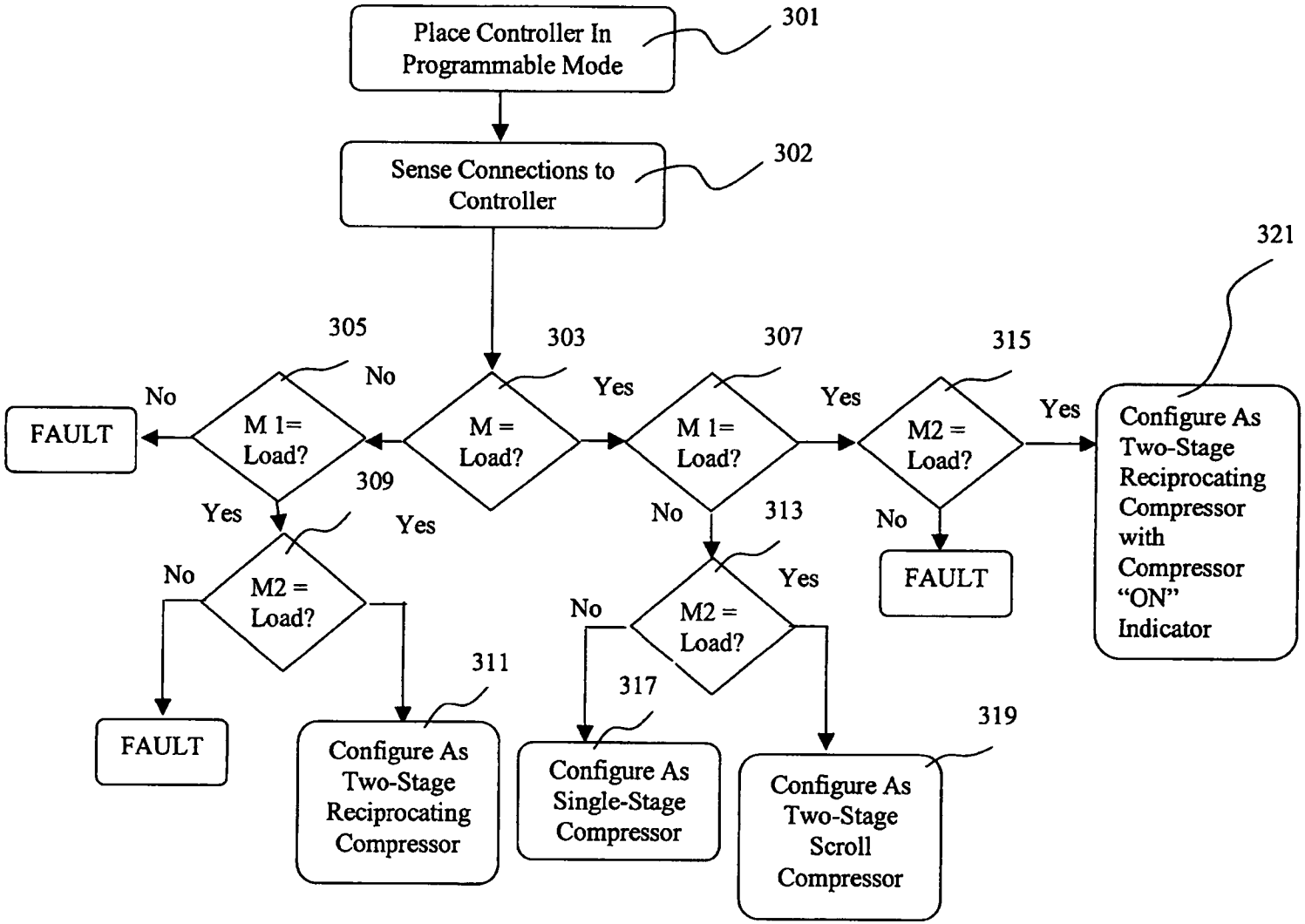
FIG. 3 illustrates a control method according to the present invention.

FIG. 3 shows a method according to one embodiment of the present invention. The processor 217 is configured to monitor inputs "$S_M$", $S_{M1}$" and $S_{M2}$" on lines 213, 211 and 209, respectively. The controller 201 is first placed in a programmable mode in step 301, which permits the controller 201 to configure itself to provide control to a determined type of compressor. The method shown in FIG. 3 may be performed at any appropriate time, including, but not limited to start-up of the controller 201 and/or when the controller receives a signal from the thermostat. Once, the controller 201 is placed in a programmable mode, the controller output lines are monitored by the processor 217 via the load sensing circuitry in step 302. A determination step 303 determines whether there is a load present on line 207. The determination of whether a load is present is done through a load sensing circuit, which determines whether a load is present on the line. If the line is not connected to a compressor related component, or there is no load on a line that is connected, the load sensing circuit will determine that there is no load on the line. If the determination in step 303 is that no load present on line 207, a determination step 305 is made. If the determination in step 303 determines that there is a load present on line 207 then a determination step 307 is made. In each of steps 305 and 307 a determination is made of whether a load is present on line 205. If the determination in step 305 determines that there is no load on line 205, then the controller 201 determines that there is a wiring error and displays a "FAULT" to the system user. A wiring fault (i.e., "FAULT", as shown in FIG. 3) may indicate that there is a problem with the system. For example, the controller 201 may be malfunctioning and may be providing incorrect outputs. Alternatively, the wiring may be incorrect as a result of incorrect installation. A wiring fault may be communicated to the system user and may indicate that the system may need service. If determination step 305 determines that there is a load on line 205, then a determination is made is step 309 of whether a load is present on line 203.

If determination step 309 determines that there is no load on line 203, then the controller 201 determines that there is a wiring error and displays a "FAULT" to the system user. If determination step 309 determines that there is a load on line 203, then the processor 217 determines that the compressor 130 attached to the system is a two-stage reciprocating compressor and configures the controller 201 in step 311 to operate a two-stage reciprocating compressor 130. If the determination step 307 determines that there is no load present on line 205, a determination step 313 is made. If determination in step 307 determines that there is a load present on line 205, then a determination step 315 is made. If determination step 313 determines that there is no load present on line 203 then the processor 217 determines that the compressor 130 attached to the system is a single stage compressor and configures the controller 201 in step 317 to operate as a single stage compressor 130. If determination step 313 determines that there is a load present on line 203, then the processor 217 determines that the compressor 130 attached to the system is a two-stage scroll compressor and configures the controller 201 in step 319 to operate a two-stage scroll compressor 130.

If determination step 315 determines that there is no load present on line 203, then the controller 201 determines that there is a wiring error and displays a "FAULT" to the system user. If determination step 315 determines that there is a load present on line 203, then the processor 217 determines that the compressor 130 attached to the system is a two-stage reciprocating compressor with a compressor "ON" indicator and configures the controller 201 in step 321 to operate a two-stage reciprocating compressor 130. In each of steps 311, 317, 319 and 321, where the controller 201 is configured, the processor 217 communicates the type of compressor to the controller 201 by way of line 219.

Although FIG. 3 has been described as a method wherein the determinations are made with on combinations of loads on output lines 203, 205 and 207, any combination of load sensing can be made, so long as the determinations provide a conclusion to which compressor 130 is present. The logic used by the processor 217 is shown in Table 2, wherein different combinations of loads are shown. Table 2 also shows the conclusion based on the combination of loads. In addition the configuration of the controller 201 is shown in Table 2 based upon the combination of loads sensed.

TABLE 2

| $S_M$ | $S_{M1}$ | $S_{M2}$ | Conclusion Based on Inputs | Configuration of Controller/Error |
|---|---|---|---|---|
| No Load | No Load | No Load | Wiring Error | FAULT |
| No Load | No Load | Load | Wiring Error | FAULT |
| No Load | Load | No Load | Wiring Error | FAULT |
| No Load | Load | Load | Two-Stage Reciprocating Compressor | Configure as Two-Stage Reciprocating Compressor |
| Load | No Load | No Load | Single Stage Compressor | Configure as Single Stage Compressor |
| Load | No Load | Load | Two-Stage Scroll Compressor | Configure as Two-Stage Scroll Compressor |
| Load | Load | No Load | Wiring Error | FAULT |
| Load | Load | Load | Two-Stage Reciprocating System with Compressor "ON" Indicator | Configure as Two-Stage Reciprocating Compressor |

FIG. 4 schematically illustrates a control system according to an alternate embodiment of the present invention. The control system includes a controller 201, a compressor 130 and a processor 217. The controller 201 and compressor 103 are arranged, substantially as shown as described with respect to FIG. 2. As in FIG. 2, output line 203 includes load sensor line 209 providing a load signal "$S_M$" and output line 205 includes load sensor line 211 provides load signal "$S_{M1}$" to processor 217. However, in this embodiment of the invention, no load sensor line is placed on output line 203. Connections for the various types of compressors for this embodiment are shown in Table 3.

TABLE 3

| Type of Compressor | M Wiring Connection | M1 Wiring Connection |
|---|---|---|
| Single Stage or Two-Stage Scroll Compressor | Yes | No |
| Two-Stage Reciprocating | No | Yes |

Figure 5:
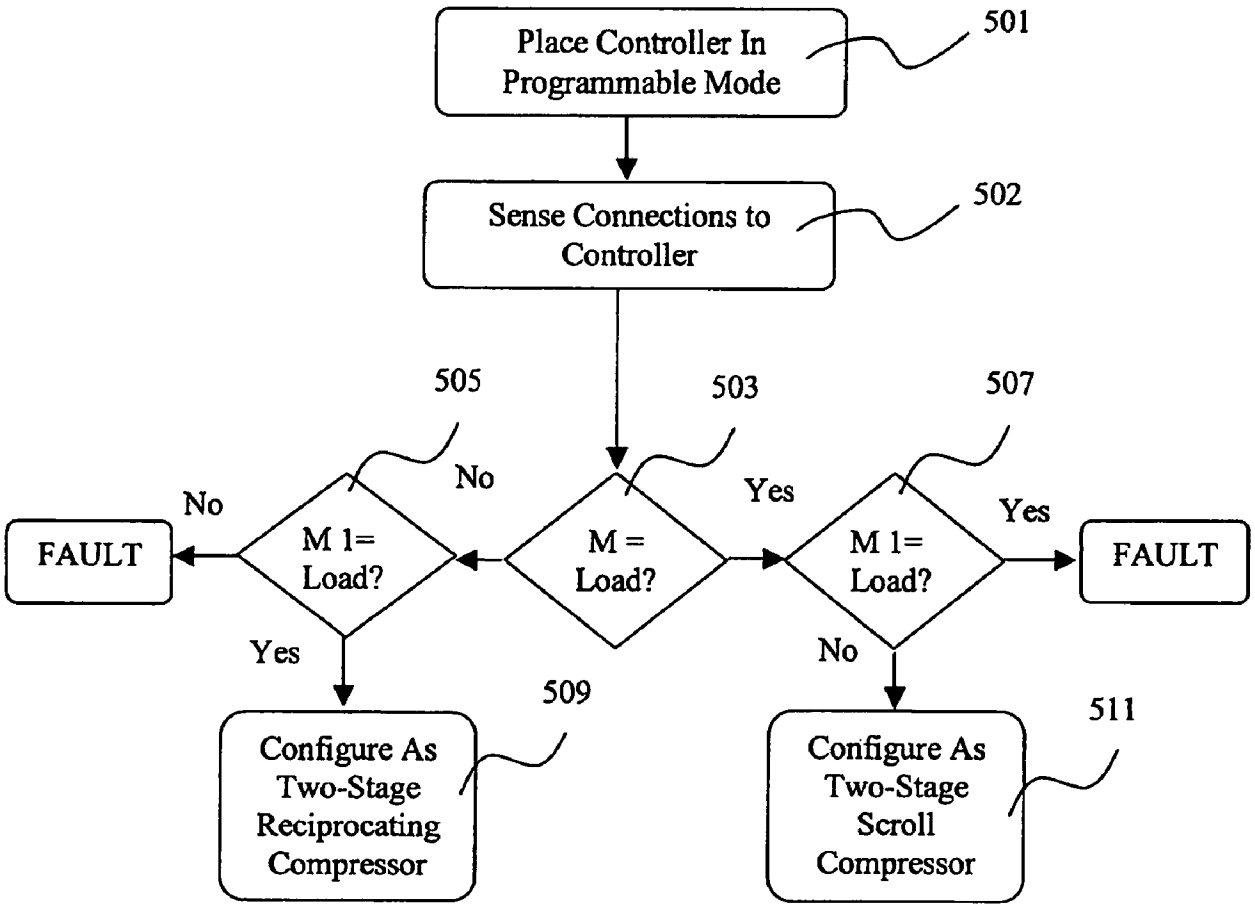
FIG. 5 illustrates a control method according to an alternate embodiment of the present invention.

FIG. 5 shows a method according to another embodiment of the present invention. As in the method shown and described with respect to FIG. 3, the controller 201 is first placed in a programmable mode in step 501, which permits the controller 201 to configure itself to provide control to a determined type of compressor. The method shown in FIG. 5 may be performed at any appropriate time, including, but not limited to start-up of the controller 201 and when the controller 201 receives a signal from the thermostat. Once the controller 201 is placed in a programmable mode, the controller output lines are monitored by the processor 217 via the load sensing circuitry in step 502. Though the controller 201 has an output line 203, no load sensor line is provided for output line 203. This embodiment of the invention permits the controller to determine the type of compressor present without the additional wiring present for the sensing of output line 203.

As shown in FIG. 5, a determination is made in step 503 whether there is a load is present on line 207. If the determination in step 503 determines that there is no load present on line 207, a determination step 505 is made. If determination in step 503 determines that there is a load present on line 207, then a determination step 507 is made. In each of steps 505 and 507, a determination of whether a load is present on line 205 is made. If determination step 505 determines that there is no load on line 205, then the processor 217 determines that there is a wiring error and displays a "FAULT" to the system user. If determination step 505 determines that there is a load on line 205, then the processor 217 determines that the compressor 130 attached to the system is wired incorrectly or a two-stage reciprocating compressor and configures the controller 201 in step 509 as a two-stage reciprocating compressor 130 operated in a single stage. Operation in a single stage permits the compressor 130 to operate safely without having to return a wiring fault.

If determination step 507 determines that there is a load on line 205, then the processor 217 determines that there is a wiring error and displays a "FAULT" to the system user. If determination step 507 determines that there is no load on line 205, then the processor 217 determines that the compressor 130 attached to the system is a single stage compressor or a two-stage scroll compressor and configures the controller 201 in step 511 as a two-stage scroll compressor 130. Operation in a two-stage scroll stage permits the compressor 130 to operate safely without harming the system if the system is a single stage. Controller 201 operation either in the two-stage scroll or the single stage compressor includes signals on M and/or M2. The activation of M2 in a single stage compressor does not damage or effect operation of the single stage compressor because the compressor would not have wiring connected to the M2 output line (i.e., output line 203 ) and would simply involve activating a line that is not connected to any component. However, if the compressor is a scroll compressor, the signals on M and M2 permit proper operation of that type of compressor. Therefore, the configuration for a load detected on "$S_M$" and no load detected on "$S_{M1}$" is a two-stage scroll compressor.

Although FIG. 5 has been described as a method wherein the determinations are made with load signal "$S_M$", and then load signal "$S_{M1}$", any combination of load detections can be made, so long as the determinations provide a conclusion to which compressor 130 is present. The logic used by the processor 217 is shown in Table 4, wherein different combinations of load signals "$S_M$" and "$S_{M1}$" are shown. Table 4 also shows the conclusion based on the combination of load signals "$S_M$" and "$S_{M1}$". In addition, the configuration of the controller 201 is shown in Table 4 based upon the load signals "$S_M$", $S_{M1}$" and $S_{M2}$".

TABLE 4

| SM | SM1 | Conclusion Based on Inputs | Configuration of Controller/Error |
|---|---|---|---|
| No Load | No Load | Wiring Error | FAULT |
| No Load | Load | Wiring Error or Two-Stage Reciprocating Compressor | Configure as Two-Stage Reciprocating Compressor |
| Load | No Load | Single State Compressor or Two-Stage Scroll Compressor | Configure as Two-Stage Scroll Compressor |

TABLE 4-continued

| SM | SM1 | Conclusion Based on Inputs | Configuration of Controller/Error |
|---|---|---|---|
| Load | Load | Wiring Error or Two-Stage Reciprocating System with Compressor "ON" Indicator | FAULT |

Although the embodiment shown in FIG. 2 including processor 217 configured to monitor inputs "$S_M$", $S_{M1}$" and $S_{M2}$" on lines 213, 211 and 209, respectively, is preferred, the embodiment shown in FIG. 4 provides a method to determine the type of compressor present that requires less wiring and therefore less cost.

Figure 6:
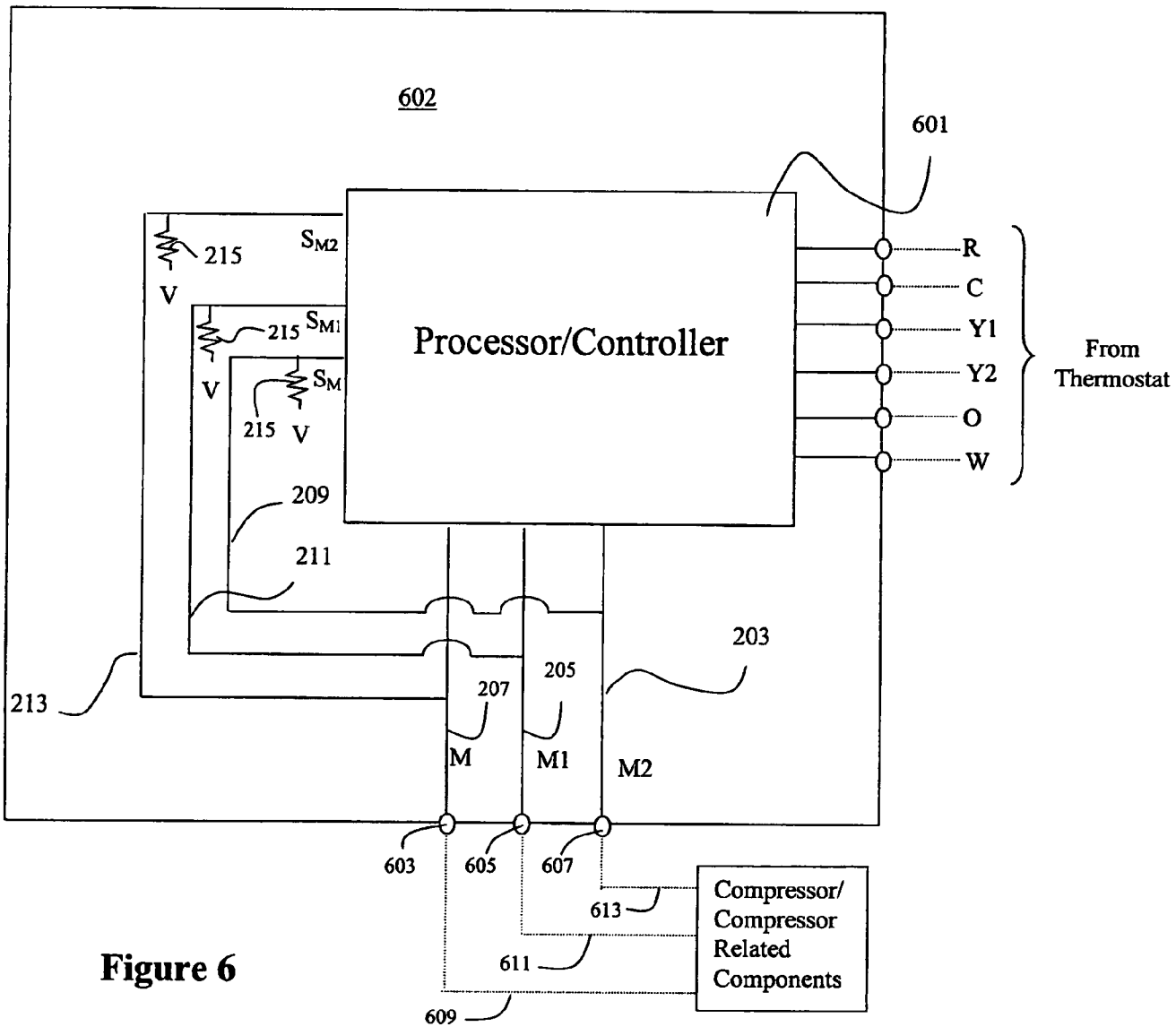
FIG. 6 schematically illustrates a control system according to another embodiment of the present invention.

FIG. 6 shows an alternate embodiment of the present invention with a processor/controller 601 mounted on a control board 602. The processor/controller 601 is configured to provide the functions of both the processor 217 and the controller 201. Specifically, the processor/controller 601 is capable of sensing loads on the output lines 203, 205 and/or 207, configuring the processor/controller 601 based upon the sensed loads and processing input signals from the thermostat or other input device to provide output signals on output lines 203, 205 and/or 207. The control board 602 includes output lines 203, 205 and 207 from the processor/controller to terminals 603, 605 and 607, respectively. The terminals include connectors capable of attaching to wiring for a compressor or compressor related component. Although FIG. 6 shows wiring attached to each of terminals 603, 605 and 607, wires may be attached to one or more of terminals 603, 605 and/or 607. The utilization of a single control board 602 embodying a processor/controller 601 permits the installation of a uniform control board 602 for a variety of systems employing a variety of different types of compressors. In order to provide the proper control for the particular type of compressor attached to the system, the manufacturer or installer of the system need only wire the system to the terminals, including terminals 603, 605 and 607 and perform a programming and/or testing method, such as the method shown and described with respect to FIGS. 3 and 5.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for configuring a controller to control a compressor comprising:

providing a controller having a plurality of output connections connectable to a compressor;

providing a detection system to determine a type of compressor connected to the controller, the detection system comprising:

a processor; and a load sensing circuit connected between the processor and the plurality of output connections of the controller;

sensing with the load sensing circuit whether a load is present on each output connection of the plurality of output connections;

providing a load signal to the processor indicating whether a load is present on each output connection;

processing the load signals with the processor to determine the type of compressor connected to the controller; and configuring the controller to control the compressor in response to the determined type of compressor.

2. The method of claim 1, wherein the step of processing the load signals includes determining the type of compressor in response to sensing a predetermined combination of loads and no loads connected to the plurality of output connections of the controller.

3. Method of claim 2 wherein plurality of output connections comprises first output connection, second output connection and third output connection.

4. The method of claim 3, wherein the compressor is selected from the group consisting of a single stage compressor, a two-stage scroll compressor, and a two-stage reciprocating compressor.

5. The method of claim 4, wherein the step of processing the sensed load signals includes determining that the compressor is a single stage compressor in response to sensing a load connected to the first output connection and no load connection to second output connection and third output connection.

6. The method of claim 4, wherein the step of processing the sensed load signals includes determining that the compressor is a two-stage reciprocating compressor in response to sensing loads connected to the second output connection and the third output connection.

7. Method of claim 4 wherein the step of processing the sensed load signals includes determining that the compressor is a two-stage scroll compressor in response to sensing loads connected to first output connection and the third output connection and no load connection to the second output connection.

8. The method of claim 2, wherein the step of processing the sensed load signals further includes determining a wiring fault in response to sensed loads and no loads connected to the plurality of output connection failing to indicate a compressor type.

9. The method of claim 1, wherein the step of sensing with the load sensing circuit includes measuring a voltage across a voltage source and resistor arranged and disposed to determine whether a signal is present between the controller and the compressor.

* * * * *